United States Patent [19]

Silvia

[11] Patent Number: 5,009,162

[45] Date of Patent: Apr. 23, 1991

[54] EXPLOSIVE LOGIC RESOLVER NETWORK

[75] Inventor: Denis A. Silvia, Aberdeen, Md.

[73] Assignee: The United States of America as represented by the Secretary of the Navy, Washington, D.C.

[21] Appl. No.: 334,849

[22] Filed: Dec. 28, 1981

[51] Int. Cl.[5] ..... F42B 3/10; F42B 15/00; F42C 19/08

[52] U.S. Cl. ..... 102/275.9; 102/305; 102/701

[58] Field of Search ..... 102/275.1-275.9, 102/221, 222, 202, 202.1, 215, 701, 305

[56] References Cited

U.S. PATENT DOCUMENTS

| | | | |
|---|---|---|---|
| 3,035,518 | 5/1962 | Coursen | 102/305 |
| 3,430,564 | 3/1969 | Siliva et al. | 102/275.9 |
| 3,496,868 | 2/1970 | Silvia et al. | 102/305 |
| 3,669,021 | 6/1972 | Spencer et al. | 102/701 X |
| 3,753,402 | 8/1973 | Menz et al. | 102/701 X |
| 3,768,409 | 10/1973 | Menz et al. | 102/275.9 |
| 3,973,499 | 8/1976 | Anderson et al. | 102/701 X |

*Primary Examiner*—David H. Brown

*Attorney, Agent, or Firm*—John D. Lewis; Kenneth E. Walden

[57] ABSTRACT

An explosive logic resolver network for determining which detonator in a plurality of detonators is the first to detonate. The resolver network is interposed between a plurality of detonators and the explosive logic clock of a safe/arming network. Each detonator is provided with a resolver network explosive trail which intersects the resolver network explosive trails of the other detonators to form a plurality of explosive logic switches. The intersections are explosively-time-equidistant from the detonators supplying the detonation signals to a given intersection such that the first detonation signal to propagate through the intersection will close the logic switch and prevent the intersection from propagating another detonation signal. When a detonator creates the first detonation signal, the signal propagates down the resolver network explosive trail, closing the switches and extinguishing at the intersections all detonations that are later in time.

10 Claims, 4 Drawing Sheets

EXPLOSIVE LOGIC RESOLVER NETWORK

BACKGROUND OF THE INVENTION

The present invention relates to an explosive logic resolver network for determining which detonator, in a plurality of detonators, is the first to detonate and start the explosive logic clock of a safe/arming network.

Prior art methods of safe/arming an explosive device consist of using mechanical deVices or exploding bridgewire devices. The mechanical safe/arming devices physically interpose a barrier between the detonator explosive charge and the main charge of the weapon. Mechanical devices have several drawbacks in that environmental degradation over an extended storage period results in an increased failure rate. In addition, as weapon designs become more complex, the requirements placed on mechanical safe/arming devices have resulted in clockwork mechanisms which are large, expensive, complex, and thus more unreliable.

Exploding bridgewire devices have no primary explosive charge in the detonator. The bridgewire device initiates the main charge by providing a tremendous pulse of high voltage current to the bridgewire which causes the bridgewire to explode. This initiates a booster which in turn initiates the main explosive charge. Because the exploding bridgewire detonator does not contain any primary explosive, the detonator may be connected directly to a booster or the main charge without the necessity of a mechanical safing mechanism. The drawback of the exploding bridgewire detonator is that it requires an expensive high voltage power supply to provide the necessary current for exploding the bridgewire. This is not generally suitable for conventional ordnance.

A more suitable method of safe/arming modern weapons systems for high reliability and safety is the use of an explosive logic network interposed between the electronically actuated detonators and a booster charge which in turn detonates the warhead. The explosive logic network, such as that disclosed in copending patent application Ser. No. 317,961, filed Nov. 4, 1981, receives an input from the detonators and performs syntactical or ordered operations to verify that a valid input combination has been received by the detonators.

In conjunction with the above safe/arming explosive logic network, copending U.S application Ser. No. 305,677, filed 9/9/81, discloses an explosive logic clock for examining a first detonation to determine whether the detonation is premature and for opening a time window during which a set of theoretically identical detonators must fire.

The explosive logic resolver network of the present invention is interposed between the detonators and the explosive logic clock and determines which detonator, among a plurality of detonators, is the first to generate a detonation signal.

SUMMARY OF THE INVENTION

Accordingly, there is provided in the present invention an explosive logic resolver network which determines which detonator is the first to generate a detonation signal and, more particularly, resolves a first detonation signal from among a plurality of detonation signals prior to inputting the signals to the explosive logic clock of a safe/arming explosive network.

The resolver network is an explosive logic network of explosive trails positioned on or in an inert substrate and interposed between the detonators and the explosive logic clock.

The explosive logic clock examines the first detonation signal generated by the first detonator to detonate of a group of detonators to determine if the detonation is premature. The clock also opens a time window during which the group of theoretically identical detonators must fire. Due to the logic sequencing of the clock, if the first detonation signal is followed by a nearly simultaneous second detonation signal then the clock will see both signals as being first and not present the second signal to the safe/arming network.

To prevent this sequence of events in the clock, the resolver network is interposed between the detonators and the explosive logic clock by providing each detonator with a resolver network explosive trail which connects each detonator with its corresponding input trail to the clock.

A particular resolver network explosive trail, for a given detonator, intersects the resolver network explosive trails of the other detonators to form a plurality of explosive logic switches. The intersections of the resolver network trails are explosively-time-equidistant from the detonators supplying the detonation signal to a given intersection. That is, a detonation signal from a first detonator will take the same time to reach a given intersection as will a detonation signal from a second detonator.

When the first detonator generates a detonation signal, the signal propagates down the particular resolver network trail, closes the logic switches and prevents the intersections from propagating later detonation signals on the remaining resolver network trails.

OBJECTS OF THE INVENTION

It is an object of the present invention to provide a resolver network for an explosive logic safe/arming device.

Another object of the present invention is to provide a resolver network determining which detonator among a group of detonators is the first to generate a detonation signal.

A further object of the present invention is to provide a resolver network which determines which detonation signal is first among a group of detonation signals.

A still further object of the present invention is to provide a resolver network which assures that only the first detonator to function will initiate an explosive logic clock even if its time priority is only a fraction of a micro-second.

A still further object of the present invention is to provide a resolver network which eliminates malfunction of an explosive logic safe/arming device caused by overlapping detonator functions.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1A:
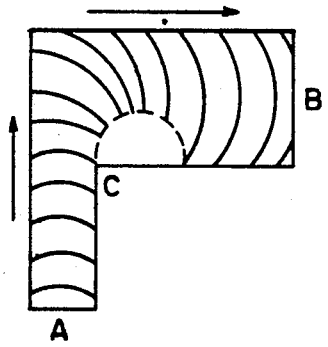
FIG. 1a PRIOR ART
FIGS. 1*a*, *b*, and *c* illustrate the corner effect in an explosive trail.
Figure 1B:
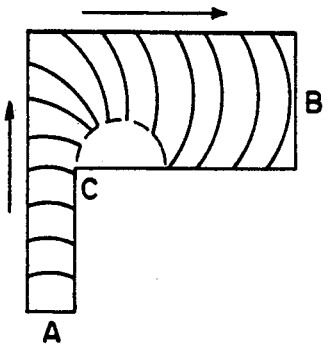
FIG. 1b PRIOR ART
Figure 1C:
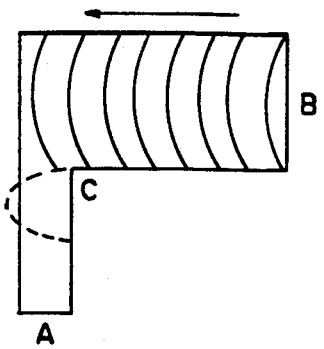
FIG. 1c PRIOR ART

Explosive logic networks for safe/arming devices of conventional and nuclear weapons are based on the "corner effect" principle discovered by Denis A. Silvia and Richard T. Ramsey of the Naval Surface Weapons Center, Dahlgren, Va. The corner effect occurs when a detonation wave propagating in an explosive sheet or trail tries to turn a sharp corner. As illustrated in FIGS. 1*a* and 1*b*, a detonation wave propagating from narrow trail A to wide trail B requires an increased width in trail B to negotiate corner C. As illustrated in FIG. 1*c*, a detonation wave propagating in an explosive trail from wide trail B to narrow trail A in negotiating corner C will turn wide around the corner and run out of room in the narrow explosive trail A and thus extinguish itself.

The principle of the corner effect can be used to establish an explosive diode or one way switch which, in effect, is the situation depicted in FIG. 1*c*. A detonation wave propagating from trail A will be able to turn the corner and proceed on to trail B but a detonation wave initiating in trail B will not be able to negotiate corner C, will extinguish itself, and will not propagate to trail A.

Figure 2A:
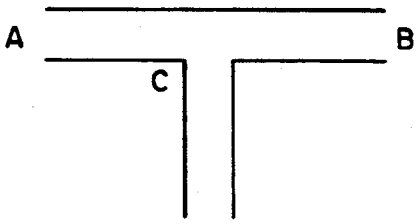
FIG. 2a PRIOR ART
FIGS. 2*a* and *b* illustrate the corner effect in a gate.
Figure 2B:
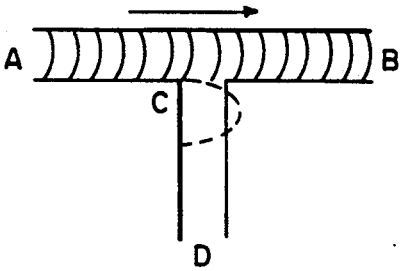
FIG. 2b PRIOR ART
Figure 3A:
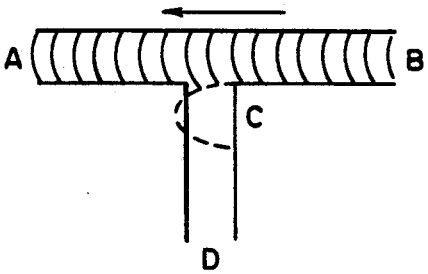
FIG. 3a PRIOR ART
FIGS. 3*a* and *b* illustrate the corner effect in a null gate.
Figure 3B:
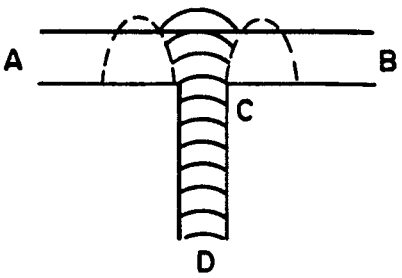
FIG. 3b PRIOR ART

As illustrated in FIGS. 2*a* and *b* and 3*a* and *b*, the corner effect can also be used to create a logic gate. FIGS. 2*a* and b illustrate a detonation wave propagating from trail A to trail B which, due to the corner effect, will not negotiate corner C and will not propagate down trail D. As illustrated in FIG. 3*a*, a detonation wave propagating from trail B to trail A will likewise not be able to negotiate corner C and thus will be prevented from propagating down leg or explosive trail D due to the corner effect. As shown in FIG. 3B, however, the detonation wave initiating in trail D will propagate to the intersection of trails A and B and will sever trails A and B and, again due to the corner effect, extinguish itself and not propagate down either trail A or trail B. The logic device described in FIG. 3*b* can be referred to as an explosive null gate. A detonation wave proceeding down trail D will disrupt trails A and B prior to a detonation wave passing along trails A and B and thus prevent passage of the detonation wave from trail A to trail B. In addition, the corner effect will prevent the detonation wave in trail D from turning into either trail A or trail B.

Figure 4:
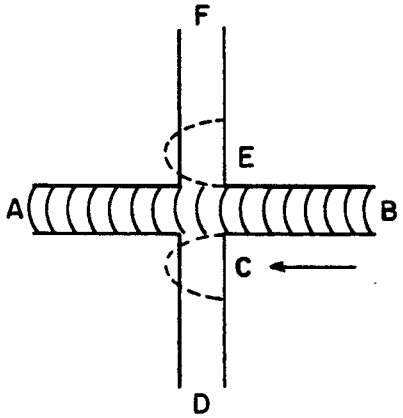
FIG. 4 PRIOR ART
FIG. 4 illustrates an intersection forming an explosive logic switch or destructive cross-over.

The principle of the corner effect, as embodied in the explosive null gate of FIG. 3, can be further extended and utilized in the intersecting explosive logic switch or destructive cross-over device of FIG. 4. A detonation wave propagating from trail B to trail A will not be able to negotiate either corner C or E and will be prevented from propagating down either explosive trail D or trail F. At the same time, the detonation wave propagating from trail B to trail A will sever trail D from trail F and prevent the later propagation of a detonation signal between trail D and trail F. The intersecting explosive logic switch of FIG. 4 provides a means for choosing between two possible sequences of events.

Typical safing systems used in conventional and nuclear warhead applications incorporate both electrical safing and mechanical safing or exploding bridgewired detonator devices. The electrical safing device ensures that a false electrical pulse is not sent to the warhead detonator. The second safing device has historically been a mechanical barrier system or high energy detonator. An explosive logic network of secondary explosive imprinted on or grooved in an inert disc can replace these and protect the warhead from accidental functioning of the detonator, whether from electrical or other causes. The explosive logic network is a pattern of explosive trails which are formed on the disc with secondary explosive which due to its characteristics does not require safing. The detonation input to the explosive logic network is provided by a set of detonators. When the correct sequence of detonator function is input to the explosive logic network, a control detonation signal is allowed to propagate through the network and on to the main explosive or warhead. Any other combination of detonator functions is deemed to be an improper combination and extinguishes the control detonation signal in the explosive logic network before it can reach the warhead.

This "combination lock" approach to safing devices allows the selection of the number and combination of detonators which results in a malfunction rate of less than one in a billion. Proper choice of the detonators can also achieve a reliability of 0.999. The explosive logic network combines safety (no warhead function when none is required) and reliability (proper warhead function on command). In addition, the explosive logic network provides for flexibility and adaptability to complex detonation schemes with reduced cost, size, and power requirements.

Figure 5:
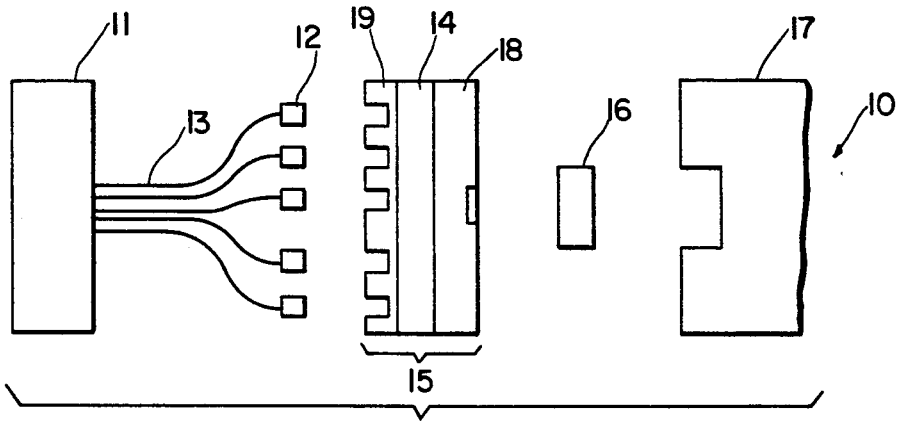
FIG. 5 PRIOR ART
FIG. 5 illustrates a safe arm device with the explosive logic resolver network incorporated into a missile or other system.

FIG. 5 illustrates an explosive logic network incorporating an explosive logic clock and the explosive logic resolver network of the subject invention, in a safe/arming device 10. The safe/arming device is provided with safe/arming electronics 11 which provide detonation signals by means of electrical conductors 13 to a set of detonators 12. The detonators are positioned in explosive logic resolver network 19 which along with logic clock 14 and safe/arming network 18 is constructed as one or more inert discs having explosive trails forming the explosive logic device 15. The output of the explosive logic network is used to initiate a booster charge 16 which in turn detonates the primary explosive charge or warhead 17.

The explosive logic network receives an input from the detonators in the form of an "object language" and performs syntactical or ordered operations to verify that a valid input combination has been received from the safe/arming electronics by means of the detonators. The safe/arming electronics receives input from the fuze and the explosive logic network validates the fuze's decision to determine whether input signals are from the fuze or from extraneous factors such as the environment. The explosive logic clock examines the first detonation to determine whether the detonation is premature. The explosive logic resolver network of the subject invention determines which detonation is first and which detonation is to be examined by the explosive logic clock.

Figure 6:
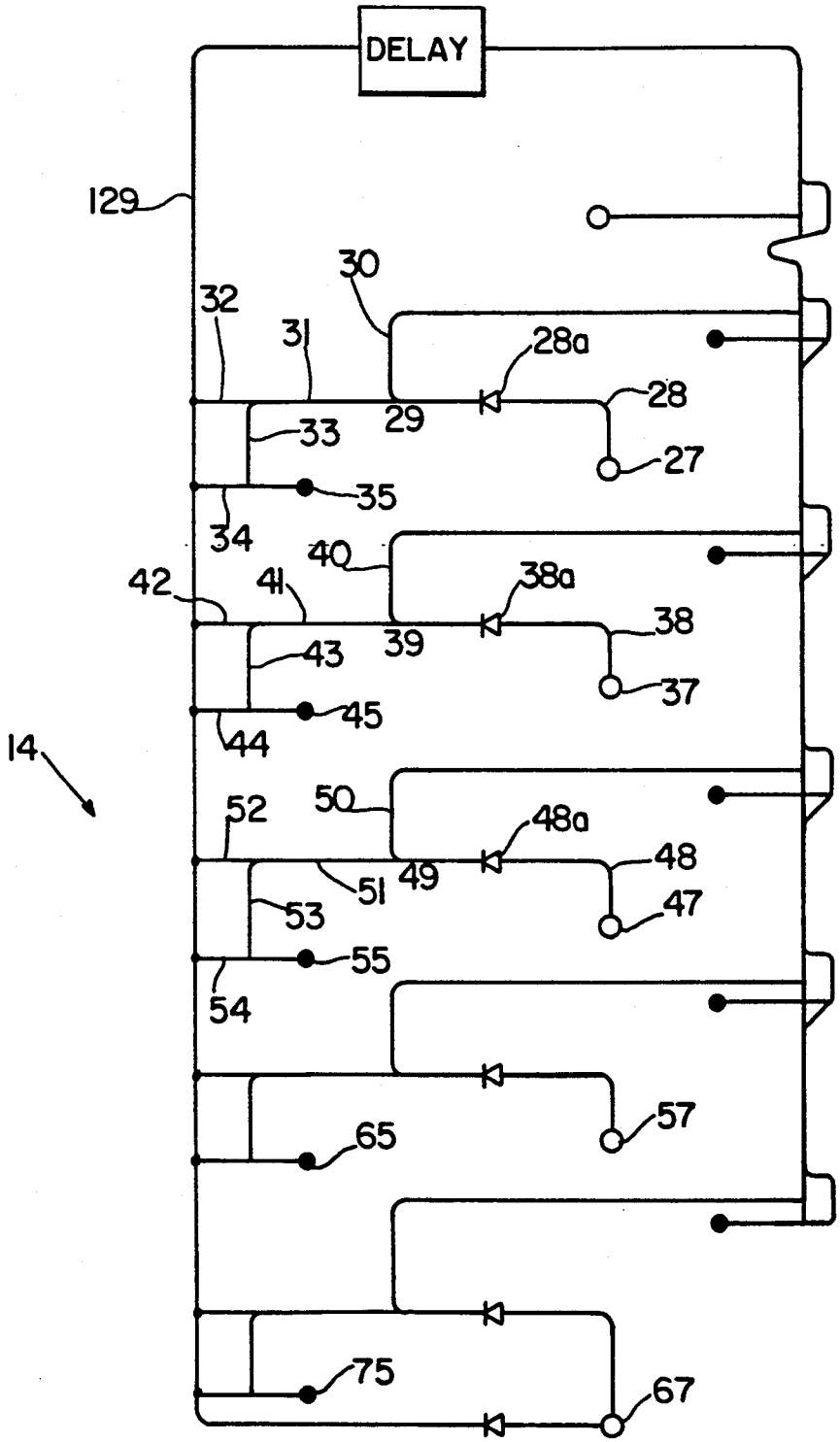
FIG. 6 illustrates a portion of an explosive logic clock.

Referring to FIG. 6, there is illustrated a simplified schematic of an upper tier portion of an explosive logic clock 14. For purposes of notation in explaining the physical layout of the clock, an explosive trail intersection provided with a dot indicates that the "corner effect" is not operative at that intersection and a detonation signal will be propagated along all exit trails. A closed circle terminus, such as that illustrated at 35, 45, 55, 65 and 75 of FIG. 6, indicates that the explosive trail is leaving the tier to arrive at another tier (not shown). An open circle terminus, such as that illustrated as 27, 37, 47, 57 and 67 o& FIG. 6, indicates that an explosive trail is arriving at the network of FIG. 6 from another tier (not shown).

Ideally, a first detonation signal propagating from open circle terminus 37, for example, initiated by a first detonator, will travel down explosive trail 38 to branching 39 where the signal splits into two components which are propagated into explosive trails 40 and 41. Explosive trail 41 propagates the detonation signal into trails 42 and 43, with explosive trail 43 acting as a null gate by intersecting and severing explosive trail 44. The null gate of explosive trail 43 prevents the detonation signal from propagating from explosive trail 42 to trail 129 and further to trail 44 and closed circle terminus 45 by severing trail 44. Because the detonation signal fails to reach closed circle terminus 45, due to null gate explosive trail 43, a detonation signal is not propagated to the lower level of explosive clock 14.

Although the detonation signal is not propagated to closed circle terminus 45, it is propagated down common explosive trail 129 and to closed circle terminuses 35, 55, 65, and 75 which convey the detonation signal back to the lower level of logic clock 14 thus setting the logic switches (not shown) for the remaining detonators.

When a second detonator generates a detonation signal which is propagated to open circle terminus 47, for example, the detonation signal is propagated down explosive trail 48 to explosive logic diode 48*a*. Because of the prior detonation of the first detonator, the explosive trail 51 has been previously consumed by the passage of the first detonation signal thus the second detonation signal terminates at explosive diode 48*a*. The preceding sequence of events assumes that the first and second detonation signals are not simultaneous so that the first detonation signal has an opportunity to complete its propagation through the logic circuitry of FIG. 6.

However, if the first and second detonation signals should be simultaneous or nearly simultaneous in time, a detonation signal would be propagated at both open circle terminus 37 and open circle terminus 47 at approximately the same time. This would result in a detonation signal being propagated down explosive trails 38 and 48, respectively, to explosive trail null gates 43 and 53, respectively. The null gates 43 and 53 would both sever explosive trails 44 and 54 and thus extinguish the detonation signals in explosive trails 44 and 54 thus preventing the detonation signals from reaching both closed circle terminuses 45 and 55, respectively. The explosive logic clock 14 would view both the first and second detonation signals as each being the first detonation signal. This would later result in malfunctioning of the explosive clock due to the closure of the time window without the clock's registering the detonation of the second detonator. To summarize, if the detonation signals are near simultaneous at open circle terminuses 37 and 47, then closed circle terminuses 45 and 55 will not be reached. In the normal course of events, only one of the detonation signals at open circle terminuses 37 and 47 is really the first detonation signal even if by only a fraction of a micro-second, such that only one of the closed circle terminuses 45 and 55 should not be reached. The result of the near simultaneous detonation signals is that both of the closed circle terminuses will not be reached and one of the near simultaneous detonation signals will not be presented to safe/arming network 18.

It is the function of the explosive logic resolver network to determine which of the near simultaneous detonation signals is to be considered the first detonation signal.

Figure 7:
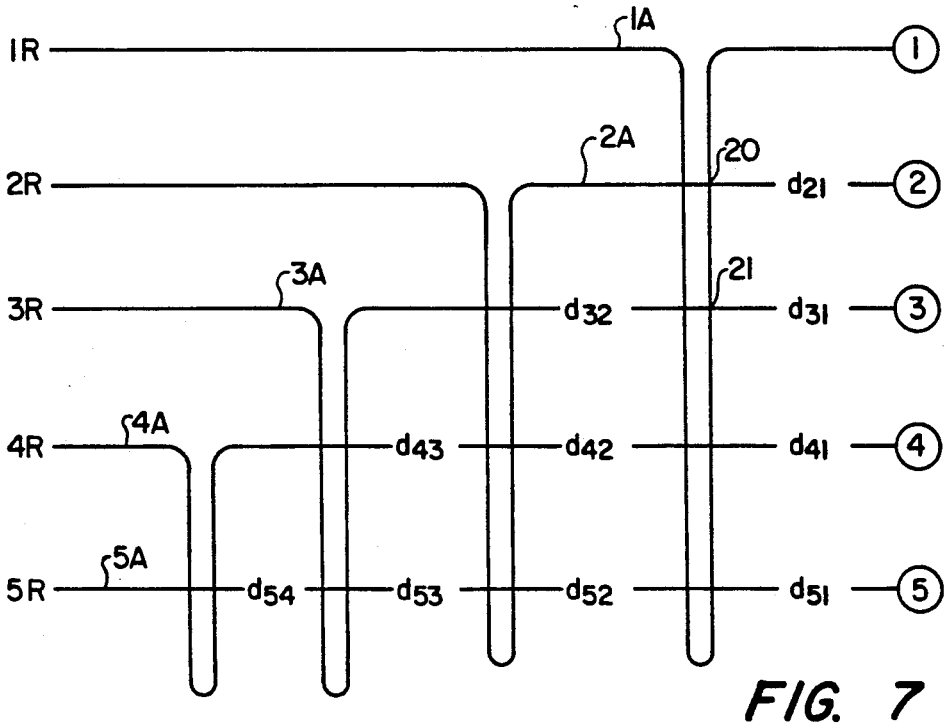
FIG. 7 illustrates the resolver network of the subject invention.

Referring to FIG. 7, there is a schematic illustration of the explosive logic resolver network of the subject invention. Numerals 1 through 5 designate a group of detonators which are theoretically identical. Each detonator is connected by means of an explosive trail to its corresponding outlet explosive trail 1R through 5R, respectively.

As illustrated in FIG. 7, detonator 1 is connected by explosive trail 1A to outlet 1R. Detonator 2 is connected by means of explosive trails 2A to outlet 2R. The remaining detonators 3 through 5 are connected to their respective trails 3A through 5A, respectively.

Explosive trail 1A is provided with an elongated U-shaped indentation or depression which intersects explosive trails 2A, 3A, 4A and 5A before traveling on to output 1R. Explosive trail 2A is likewise furnished with an adjacent elongated U-shaped indentation which intersects explosive trails 3A, 4A and 5A before traveling on to output 2R. Likewise, explosive train 3A is furnished with an adjacent elongated U-shaped indentation which intersects explosive trails 4A and 5A before connecting with outlet 4R. Explosive trail 5A is not provided with an indentation in the illustration, however, it is to be understood explosive trail 5A could also be provided with such an indentation, especially if it is desired that additional detonators and explosive trails be added to the resolver network. It can thus be seen from FIG. 7 that the resolver network of the subject invention is formed with a series of adjacent U-shaped explosive trails which for a given explosive trail intersect the remaining explosive trails.

By way of understanding the operation of the resolver network, it must be understood that the intersections of the explosive trails are such that they form intersecting explosive null gates or logic switches between the given explosive trails such as the null gates or destructive cross-overs illustrated in FIG. 4. The null gates are positioned in the explosive trails so as to be explosively-time-equidistant from the particular detonators furnishing the detonation signals to a given intersection. The term "explosively-time-equidistant" conveys the concept that simultaneous detonation signals created by the detonators for a given intersection will arrive at the intersection at the same time. If there is a fraction of a micro-second difference, then one detonation will arrive at the intersection first.

By way of example, the intersection of explosive trail 1A with explosive trail 2A at intersection 20 is explosively-time-equidistant from both detonator 1 and detonator 2 as indicated by d21. Likewise the intersection of explosive trail 1A with explosive trail 3A at point 21 is explosively-time-equidistant from both detonator 1 and detonator 3 as indicated by d31. Because the null gate intersections, such as 20 and 21, are equidistant from the detonators furnishing the detonation signals to these intersections, a prior detonation signal originating at either of the detonators, even if it is only a microsecond prior in time, will reach the intersection first, function as a null gate, sever the other explosive trail and prevent the later-in-time detonation signal from passing through the intersection.

Thus a first detonation signal propagating down the corresponding explosive trail for a given detonator, if it is prior in time to another detonation signal, will pass through the null gate intersections or logic switches 20 and 21, sever the other explosive trail and extinguish the later detonation signal when it reaches the null gate intersection. Although the concept of the invention has been illustrated only with respect to intersections 20 and 21, it is to be understood that the remaining intersections between the explosive trails 1A, 2A, 3A, 4A and 5A function in like manner. The functioning of the resolver network of FIG. 7 results in a single detonation signal being propagated to only one of the outlet explosive trails 1R through 5R.

Figure 8:
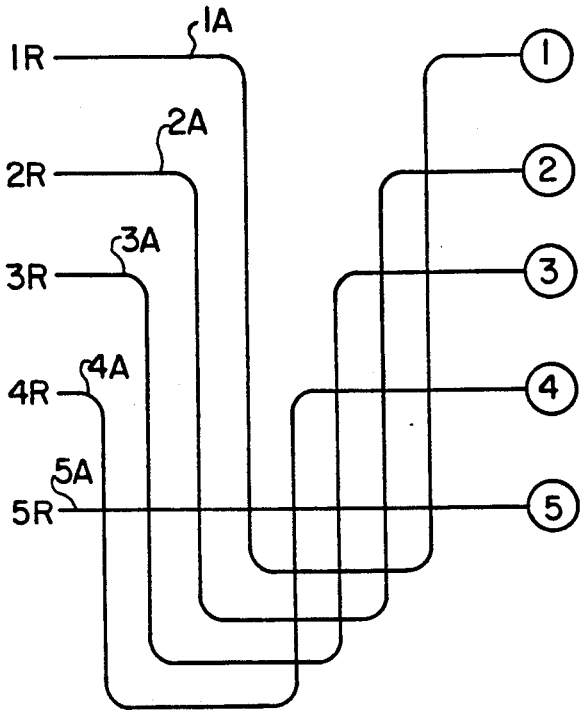
FIG. 8 illustrates a variation of the network illustrated in FIG. 7.
Figure 9:
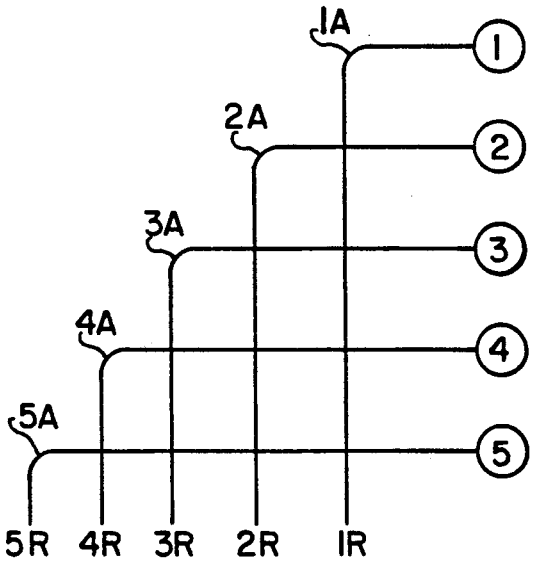
FIG. 9 illustrates a further variation of the network illustrated in FIG. 7.

Referring to FIGS. 8 and 9, there are disclosed additional embodiments of the explosive logic resolver network which are encompassed by the concept of the invention. FIG. 8 illustrates a resolver network with nested, U-shaped explosive trails as opposed to the adjacent U-shaped trails of FIG. 7. FIG. 9 discloses a revolver network composed of nested, corner-shaped explosive trails. Both the networks illustrated in FIG. 8 and FIG. 9 result in the null gate intersection of the explosive trails 1A through 5A to form logic switches as in the resolver network disclosed in FIG. 7. Again, explosive trail 5A, although illustrated in FIG. 8 without the U-shape, could be provided with a nested U-shape especially if additional detonators and explosive trails are added to the resolver network.

Referring again to the upper tier of the explosive logic clock illustrated in FIG. 6, it is to be understood that the resolver network of the subject invention as disclosed in FIGS. 7, 8 or 9 is to be interposed in the safe/arming network 15 prior to open circle terminuses 27, 37, 47, 57, and 67, so as to determine which detonation signal among a group of detonation signals is first in time. It should be further understood that the resolver network may be interposed in any convenient portion of the safe/arming network between the detonators and the functioning of the explosive logic clock. Additionally, it must be further understood that after the resolver network has determined which detonation signal is first, the remaining detonation signals which are extinguished in the resolver network may be routed by means of a time delay (not shown) to the inputs for the explosive logic clock. By this means the explosive logic resolver network may determine which detonation signal is first in time among a group of detonation signals and also, after a time delay, route all the detonation signals to the explosive logic clock.

It is thus apparent that the disclosed exPlosive logic resolver network provides a means or determining which detonator among a group of detonators is the first to generate a detonation signal. The resolver network of the subject invention assures that only the first detonator to function will initiate an explosive logic clock for a safe/arming device and thus eliminates malfunction of the safe/arming device due to overlapping detonator functions.

Many obvious modifications and embodiments of the specific invention other than those set forth above will readily come to mind to one skilled in the art having the benefit of the teachings presented in the foregoing description and the accompanying drawings of the subject invention, and hence it is to be understood that such modifications are included within the scope of the appended claims.

I claim:

1. An explosive logic network for resolving a first detonation signal from a plurality of detonation signals, comprising:
   - detonation signal means;
   - explosive trail means propagating the detonation signals from the detonation signal means; and
   - resolution means extinguishing all detonation signals in the explosive trail means except for a first detonation signal.

2. The network of claim 1 further comprising explosive outlet trail means which propagate the first detonation signal to a safe/arming network clock.

3. The network of claim 1 wherein the resolution means comprise one or more explosive logic switches in the explosive trail means.

4. The network of claim 3 wherein the explosive trail means comprise a plurality of explosive trails, each of the plurality of explosive trails intersecting the other explosive trails at a point time equidistant from the detonation signal means propagating the detonation signals to the intersecting trails so as to form the explosive logic switches.

5. The network of claim 3 wherein the one or more logic switches are formed by one or more intersections of the explosive trail means such that a first detonation signal propagating down the explosive trail means will extinguish all other detonation signals propagating in the explosive trail means.

6. The network of claim 5 wherein the one or more intersections of the explosive trail means are time equidistant from the detonation signal means propagating the detonation signals to a given intersection.

7. An explosive logic network for resolving a first detonation signal from a plurality of detonation signals, comprising:
   - detonation signal means;
   - explosive trail means;
   - resolution means extinguishing all detonation signals except for a first detonation signal, said resolution means comprising one or more logic switches in the explosive trail means, each logic switch being formed by an intersection in the explosive trail means which is time equidistant from the detonation signal means propagating detonation signals to a given intersection.

8. The network of claim 7 wherein the explosive trail means comprise a plurality of corner-shaped explosive trails, said corner-shaped trails being nested such that each trail crosses the remaining trails.

9. The network of claim 7 wherein the explosive trail means comprise a plurality of U-shaped explosive trails, said U-shaped trails being nested such that each trail crosses the remaining trails.

10. The network of claim 9 wherein the U-shaped explosive trails are interposed adjacently such that each trail crosses the remaining trails.

* * * * *